US011338889B2

(12) United States Patent
Shearer et al.

(10) Patent No.: US 11,338,889 B2
(45) Date of Patent: May 24, 2022

(54) DRIVE MECHANISM FOR BIMINI TOP SYSTEM

(71) Applicant: Lippert Components, Inc., Elkhart, IN (US)

(72) Inventors: Robert R. Shearer, Bradenton, FL (US); Dominic Layne, South Bend, IN (US); Samuel Evans, Granger, IN (US); Mark Kinder, Clarkshill, IN (US)

(73) Assignee: Lippert Components, Inc., Elkhart, IN (US)

( * ) Notice: Subject to any disclaimer, the term of this patent is extended or adjusted under 35 U.S.C. 154(b) by 12 days.

(21) Appl. No.: 16/995,429

(22) Filed: Aug. 17, 2020

(65) Prior Publication Data

US 2021/0047003 A1 Feb. 18, 2021

Related U.S. Application Data

(60) Provisional application No. 62/888,113, filed on Aug. 16, 2019.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 6,327,993 | B1 | 12/2001 | Richens, Jr. | |
| 7,334,822 | B1 | 2/2008 | Hines, Jr. | |
| 7,389,737 | B1 * | 6/2008 | Schwindaman | B63B 17/02 114/361 |
| 7,438,015 | B1 | 10/2008 | Schwindaman | |
| 7,571,691 | B2 | 8/2009 | Russikoff | |
| 8,752,498 | B1 * | 6/2014 | Schwindaman | B63B 17/02 114/361 |
| 9,038,875 | B2 | 5/2015 | Jesewitz | |
| 9,102,384 | B2 | 8/2015 | Pierce et al. | |
| 10,173,754 | B2 | 1/2019 | Parniske et al. | |
| 10,513,314 | B2 | 12/2019 | Parniske et al. | |

* cited by examiner

*Primary Examiner* — Lars A Olson
(74) *Attorney, Agent, or Firm* — Nixon & Vanderhye P.C.

(57) ABSTRACT

A drive mechanism for a bimini top with a pair of bimini arms supporting the bimini top includes a motor, a worm screw coupled with the motor for rotation by the motor, and a driven gear coupled with the worm screw. One of the pair of bimini arms is connected to the driven gear, and the driven gear is configured for displacement between a stowed position and an extended position by operation of the motor. A pivot hub engages the driven gear via an intermediate hub, and the other of the pair of bimini arms is connected to the pivot hub. The pivot hub and intermediate hub are configured for displacement between a down position and an up position by operation of the motor through the driven gear and the intermediate hub. A first arc spanned by the driven gear between the stowed position and the extended position is greater than a second arc spanned by the pivot hub between the down position and the up position.

14 Claims, 9 Drawing Sheets

DRIVE MECHANISM FOR BIMINI TOP SYSTEM

CROSS-REFERENCES TO RELATED APPLICATIONS

This application claims the benefit of U.S. Provisional Patent Application No. 62/888,113, filed Aug. 16, 2019, the entire content of which is herein incorporated by reference.

STATEMENT REGARDING FEDERALLY SPONSORED RESEARCH OR DEVELOPMENT (NOT APPLICABLE)

BACKGROUND & SUMMARY

A bimini top is generally provided on a boat or aquatic vehicle for providing shade from the sun while the boat is in use. Many bimini designs extend or retract the canvas or cover either manually or using hydraulic cylinders from a metal supporting frame. Manual biminis can be laborious for the user when out on the water, and hydraulic cylinders on other biminis can take up usable space on the boat and could be a hassle for the user if the cylinder is damaged or not functioning correctly. Other previous bimini designs use drive screws or rack and pinion systems, which may require a lot of power to drive the system to full extension and may be prone to mechanical issues. It is desired to have a bimini installed on a boat that requires minimal work for the user, takes up minimal space, and runs in a way that is generally uninhibited.

The bimini top system of the described embodiments is constructed for installation on a boat having two generally parallel sides. An actuation mechanism is mounted to each side of the boat and includes a driven hub or actuator, an intermediate hub or actuator, a pivot hub or actuator, a worm gear, and a motor. The intermediate hub is round and contains gear teeth on less than its entire circumference. The driven hub contains gear teeth that mesh with and drive the teeth of the intermediate hub. A lip on the intermediate hub pivots the pivot hub. A bimini arm or strut is mounted to each of the driven hub and pivot hub on each side of the boat and a canopy is connected between them. The worm gear actuates the driven hub and associated arm between stowed and deployed positions and pivots the pivot hub and associated arm between stowed and deployed positions for deploying and stowing the canopy. The use of the worm gear in the bimini top system prevents back driving of the system and is more efficient than other motor driven bimini systems.

In an exemplary embodiment, a drive mechanism for a bimini top with a pair of bimini arms supporting the bimini top includes a motor, a worm screw coupled with the motor for rotation by the motor, and a worm gear coupled with the worm screw. The worm gear defines a driven hub to which one of the pair of bimini arms is connectable. An intermediate hub coupled with the driven hub includes gear teeth along a first portion of its circumference, a smooth edge along a second portion of its circumference, and a lip. A pivot hub engaging the intermediate hub includes a cam engaging the lip of the intermediate hub. The pivot hub includes a smooth circular valley engageable with the smooth edge of the intermediate hub, where the other of the pair of bimini arms is connectable to the pivot hub.

The driven hub may be rotatable across an arc greater than 90 degrees, such as across an arc between 120-180 degrees.

The pivot hub may be rotatable across an arc less than 90 degrees, such as across an arc between 10-60 degrees.

In another exemplary embodiment, a bimini system for installation on a boat may include the drive mechanism of the described embodiments, a pair of bimini arms connected to the drive mechanism, and a canopy connected between the pair of bimini arms. In this context, where the boat includes a port side and a starboard side, the bimini system may include two of the drive mechanisms secured to the port side and the starboard side, respectively, where the bimini arms may be connected between the two drive mechanisms. Each of the drive mechanisms may be secured in a housing.

In yet another exemplary embodiment, a drive mechanism for a bimini top with a pair of bimini arms supporting the bimini top includes a motor, a worm screw coupled with the motor for rotation by the motor, and a driven gear coupled with the worm screw. One of the pair of bimini arms is connected to the driven gear, and the driven gear is configured for displacement between a stowed position and an extended position by operation of the motor. A pivot hub engages the driven gear via an intermediate hub, and the other of the pair of bimini arms is connected to the pivot hub. The pivot hub and intermediate hub are configured for displacement between a down position and an up position by operation of the motor through the driven gear and the intermediate hub. A first arc spanned by the driven gear between the stowed position and the extended position is greater than a second arc spanned by the pivot hub between the down position and the up position.

In still another exemplary embodiment, a bimini system for installation on a boat with first and second sides includes a first drive mechanism mounted to the first side of the boat and including a first actuator, a first worm screw rotatably driven by the first actuator, a first worm gear engaging the first worm screw, and a first gear train engaging the first worm gear. A first bimini arm and a second bimini arm are mounted to and rotatable with the first gear train. A canopy is connected between the first and second bimini arms.

The bimini system may further include a second drive mechanism mounted to the second side of the boat and including a second actuator, a second worm screw rotatably driven by the second actuator, a second worm gear engaging the second worm screw, and a second gear train engaging the second worm gear. The first and second bimini arms may be mounted to and rotatable with the second gear train. The first drive mechanism may be contained within a first housing, and the second drive mechanism may be contained within a second housing.

In still another exemplary embodiment, a bimini system for installation on a boat includes a pair of arms pivotally mounted to the boat for pivotal movement relative to one another, a canopy supported by the arms, and a drive mechanism for moving the arms from a stowed position in which the canopy is folded to a deployed position in which the canopy is extended to cover at least a portion of the boat. The drive mechanism includes a worm screw drivingly connected to a worm gear, and a gear train drivingly connecting the worm screw with the arms whereby rotation of the worm gear rotates a first arm actuator. The first arm actuator is drivingly connected with an intermediate arm actuator, and the intermediate arm actuator is drivingly connected with a second arm actuator to move the arms between the stowed and deployed positions as the worm screw is actuated.

A motor may be connected to and actuates the worm screw. The first arm actuator may contain gear teeth, the intermediate arm actuator may contain gear teeth, and the gear teeth of the first arm actuator may drivingly engage the gear teeth of the intermediate arm actuator. In this context, the intermediate arm actuator may further include a smooth circular surface, where the second arm actuator includes a complementary smooth circular surface. The second arm actuator may further include a valley, and the intermediate arm actuator may further include a protrusion, where the protrusion interacts with the valley to pivot the second arm actuator into sliding engagement with the intermediate arm actuator. The intermediate arm actuator smooth circular surface may abut the second arm actuator smooth circular surface. In some embodiments, both of the first arm actuator and the second arm actuator may be fixedly connected to an arm.

BRIEF DESCRIPTION OF THE DRAWINGS

These and other aspects and advantages will be described in detail with reference to the accompanying drawings, in which.

DETAILED DESCRIPTION

Figure 1:
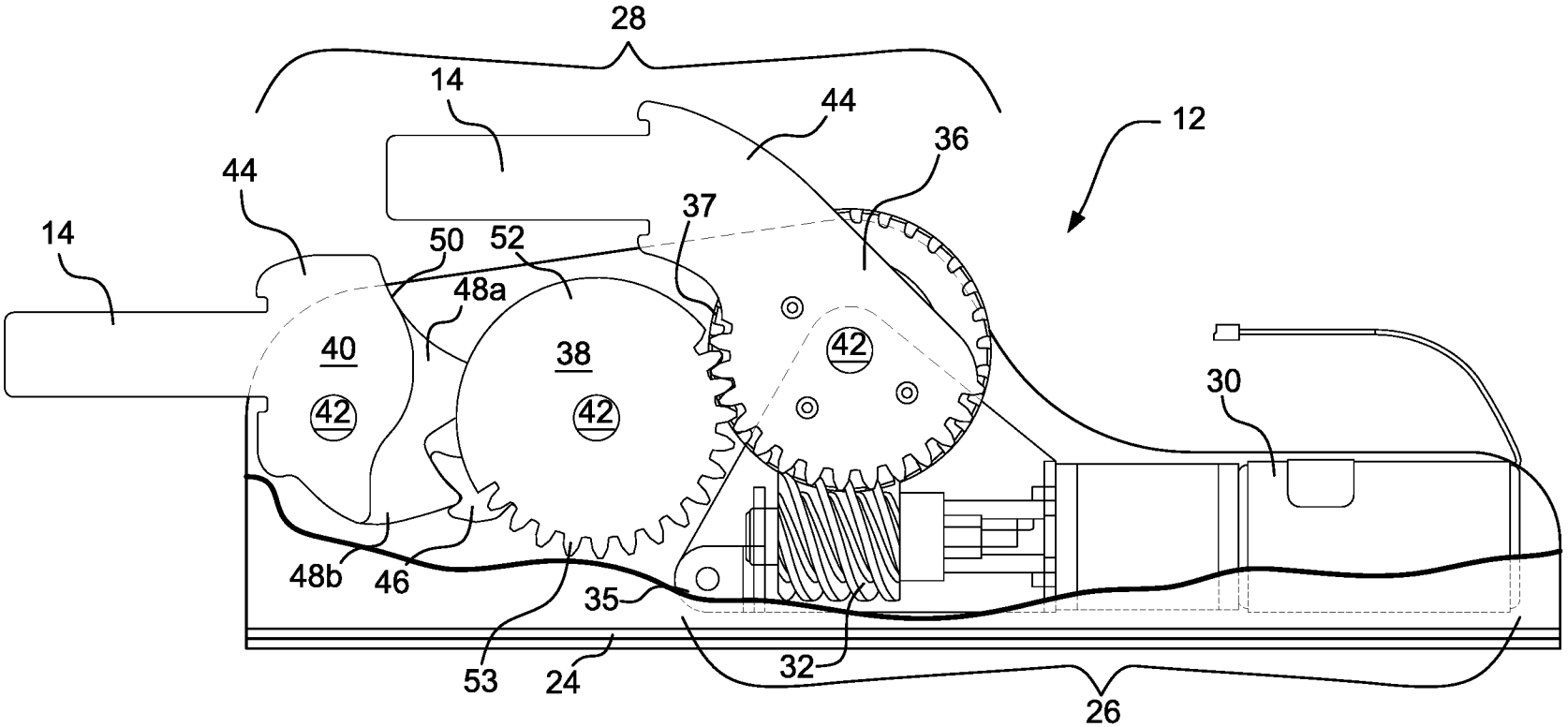
FIG. 1 is a partial phantom side view of the drive mechanism of the bimini top system according to the present disclosure in the stowed position.

The present embodiment of the bimini top system 10 includes a drive mechanism 12 for raising and lowering bimini arms or struts 14 carrying a canopy, cover, or awning 16 for providing shade to a user on a boat. Generally, the system 10 is mounted on a boat with at least two opposing, parallel sides (not shown). This bimini top system 10 could also be implemented in other applications where shade from the sun is desired. The drive mechanism 12 actuates the bimini arms 14 between deployed and stowed positions.

Figure 7:
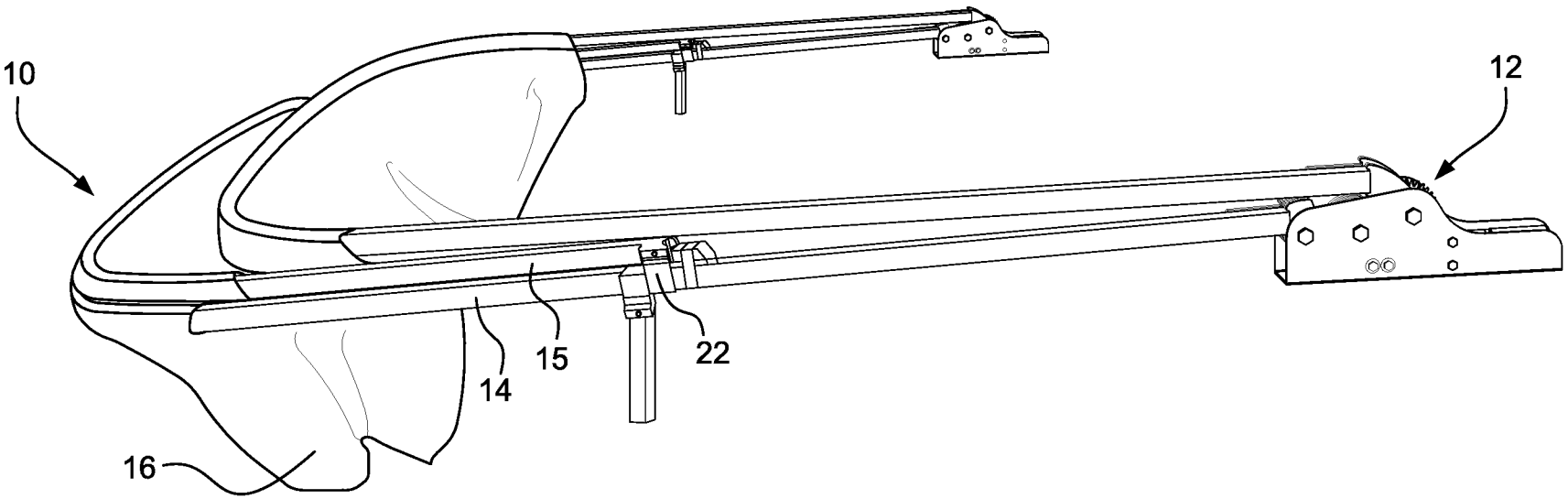
FIG. 7 is a perspective view of the bimini top system of the present disclosure in the stowed position.
Figure 9:
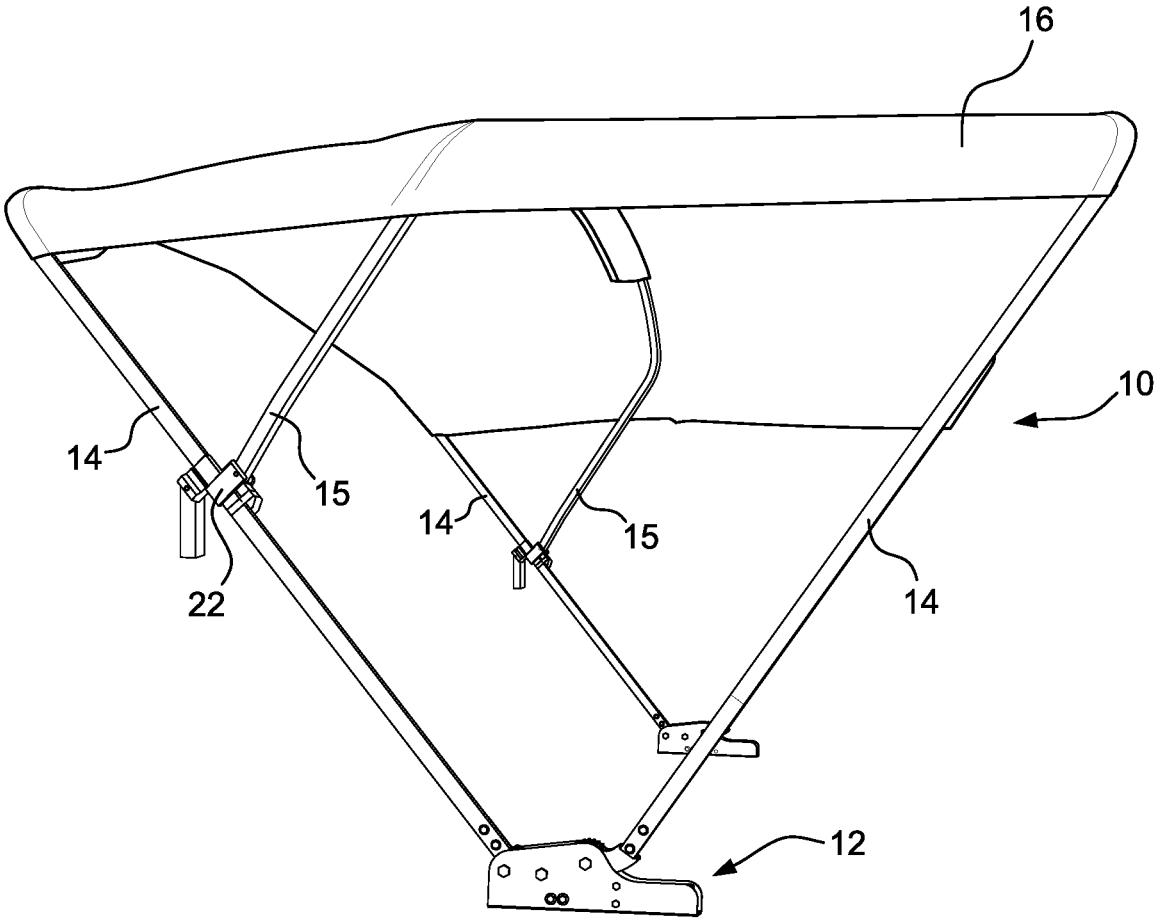
FIG. 9 is a perspective view of the bimini top system of FIG. 7 in a deployed position.

In the stowed position as shown in FIG. 7, the bimini arms 14 rest upon themselves in a generally horizontal position and angle towards one end of the boat so that they are out of the way of the user and clear of the usable floor space of the boat. In the deployed position as shown in FIG. 9, the bimini arms 14 are actuated to a generally vertical position but may be slightly angled in opposite directions so that the canopy 16 is fully extended and stretched to provide maximum sunshade for the user.

In some embodiments, the bimini arms 14 are U-shaped hoops that arc to connect opposite sides of the boat. In other embodiments, a separate connecting bar (not shown) may connect corresponding arms or struts, or the canopy 16 may be mounted to the respective arms such that a connecting arm is not necessary.

The canopy may be made of any canvas, fabric, or other material suitable for an outdoor sunshade, and it may be mounted to the bimini arms in any mounting method known in the art. In some embodiments, the canopy is mounted to front and back bimini hoops and may hang and fold on itself when the bimini top is in the stowed position.

One bimini arm may differ in length from the other. For example, the bimini arm nearest the front of the boat may be longer than the arm nearest the rear of the boat in order to stretch the canopy a longer distance and subsequently provide more sunshade. In the embodiment shown in FIG. 9, there may also be a smaller secondary arm or strut 15 pivotally coupled to one or both bimini arms 14 and connected to the canopy 16 approximately midway down the length of the material for assisting in deployment and retraction of the canopy. In such an embodiment, a spring or other biasing member 22 is disposed on or within the secondary arm 15 in relation to the connecting bimini arm 14 to bias the secondary arm 15 and the canopy 16 towards the retracted position. In another embodiment, the canopy 16 may be wrapped around one or both of the hoops of the bimini arms 14 when in the stowed position and then booted for storage (not shown).

The drive mechanism 12 is contained in a housing 24, with one housing mounted to each side of the boat structure. The housing is generally made of aluminum but could also be made of any other suitable metal or composite material for withstanding outside elements. The housing 24 could be mounted to the boat structure by any known method of securement, including but not limited to bolting, welding, or the use of adhesives. The housing as shown is generally U-shaped with three walls, an open top, and two open ends for installation of the drive mechanism components and for uninhibited movement of the bimini arms 14. In other embodiments, the housing 24 could have more or fewer than three walls or may have other modifications such as a top cover (not shown) for preventing the entry of water.

The housing 24 contains the components of the drive mechanism 12. As shown, the drive mechanism may include a motor 30, a worm screw 32, a worm gear 34, a driven hub 36, an intermediate hub 38, and a pivot hub 40. The components can be collectively referred to as the actuation mechanism 26 and the gear train 28, both of which will be described in more detail below.

Figure 5:
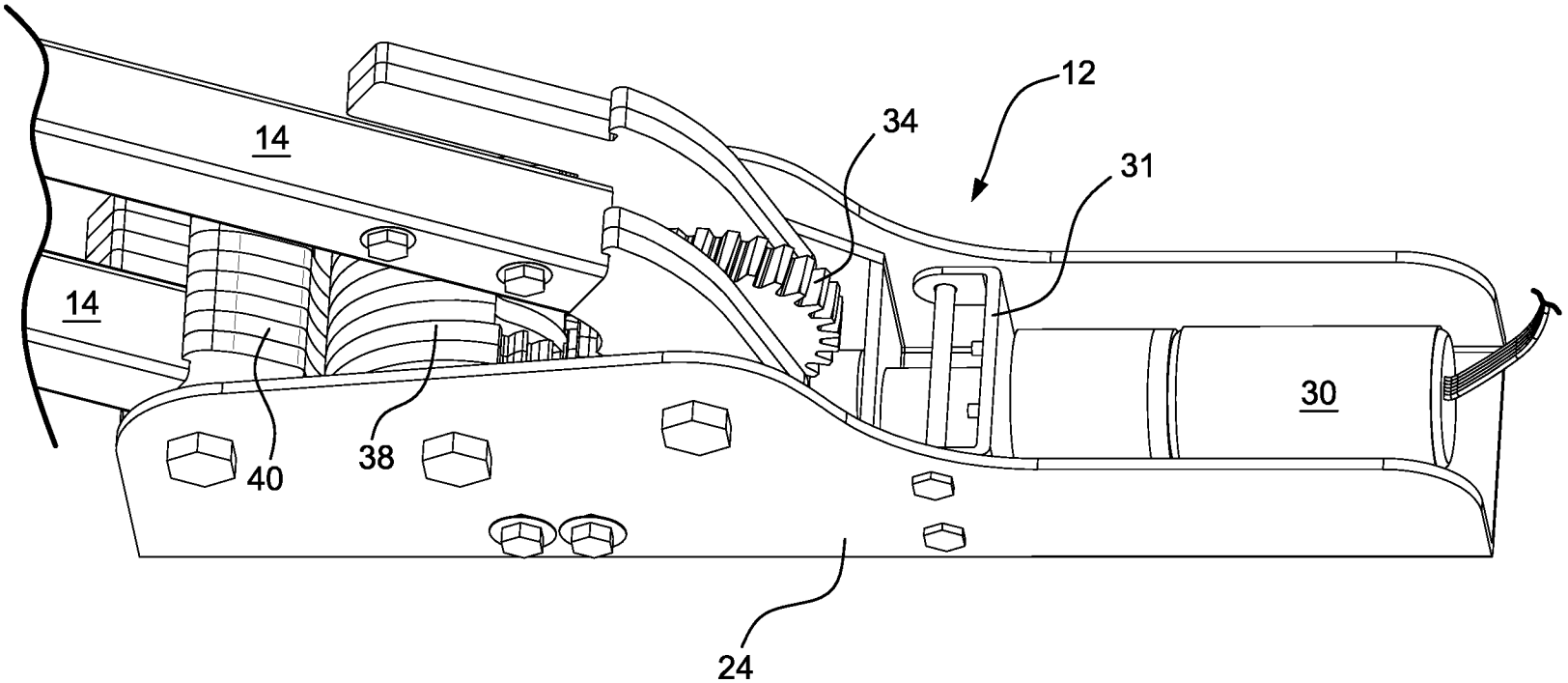
FIG. 5 is a top perspective view of the bimini drive mechanism of FIG. 1.

The actuation mechanism 26 includes the motor 30, worm screw 32, and worm gear 34. The worm screw 32 and worm gear 34 could generally be referenced together as a worm drive 33. In the embodiment shown, the motor 30 is secured within the housing 24, but may be excluded from the housing or may otherwise be covered in other embodiments. In another embodiment, bevel gears or other connectors (not shown) may be used to couple the motor 30 to the worm drive 33. As shown in FIG. 5, brackets 31 are bolted through opposite sides of the U-shaped housing 24 for mounting and stabilizing the motor. The motor 30 may directly engage the worm screw 32, or a worm shaft (not shown) may be used to communicate power from the motor to the worm screw. The worm screw 32 may also be secured and positioned in the housing 24 by a bracket 35 that is bolted into opposite sides of the housing. The worm screw 32 is generally positioned below the gear train 28 for communicating power through the worm drive 33 and driving the gear train 28.

The gear train 28 includes a driven hub 36, an intermediate hub 38, and a pivot hub 40. As shown, each hub is rotatable about a bolt or axle 42 secured through opposite sides of the U-shaped housing 24. The driven hub 36 is operably connected with the worm gear 34 driven by the worm screw 32 and has gear teeth 37 in meshing engagement with gear teeth 53 of the intermediate hub 38. The driven hub 36 also includes an arm connector 44 for mating connection with a bimini arm 14. The intermediate hub 38 is circular with the gear teeth 53 on approximately half of its circumference and a smooth edge 52 on approximately the other half of its circumference. The ratio of gear teeth to smooth edge of the intermediate hub 38 could be modified based on the design and power transfer needs of the gear train 28. The intermediate hub 38 also has a protrusion or lip 46 proximate its smooth edge. The pivot hub 40 contains a two-pronged cam 48 on its lower end with top 48*a* and bottom 48*b* prongs and a smooth circular valley 50 on its upper end that is complementary to the smooth edge 52 of the intermediate hub 38. Like the driven hub 36, the pivot hub 40 includes an arm connector 44 for mating connection with a bimini arm 14.

The worm screw 32 actuates the worm gear 34 that is rotatably fixed with the driven hub 36, which rotates the driven hub and associated bimini arm 14. The gear teeth 37 of the driven hub 36 also drive the gear teeth 53 of the intermediate hub 38. As the intermediate hub rotates, the lip 46 of the intermediate hub 38 pivots the pivot hub 40 as it pushes one of the top or bottom prongs 48*a*, 48*b* of the pivot hub cam 48. The pivot hub 40 is maintained in the upwardly pivoted position by the sliding interaction between the smooth edge 52 of the intermediate hub 38 and the smooth circular valley 50 of the pivot hub 40.

Figure 2:
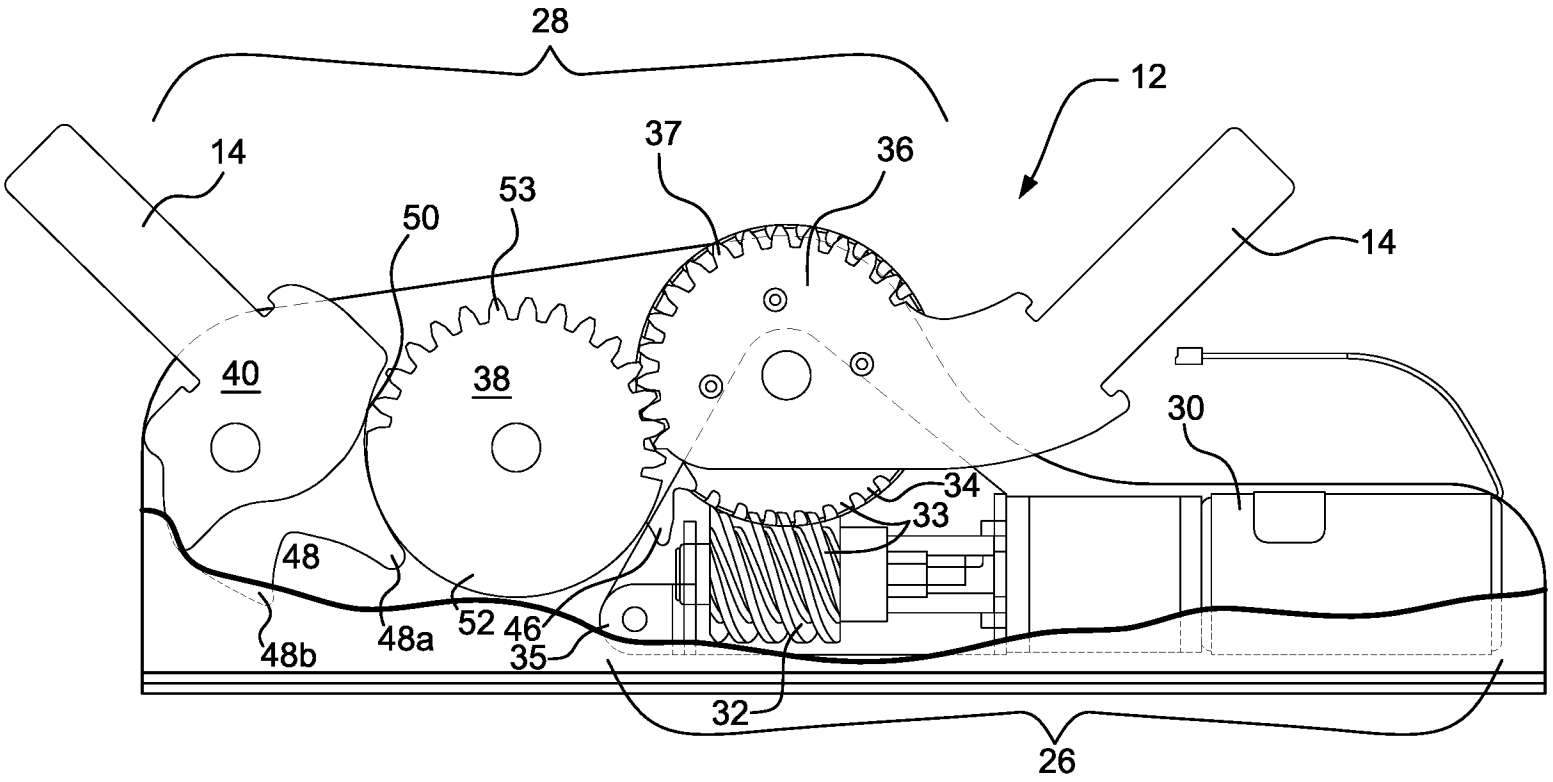
FIG. 2 is a partial phantom side view of the bimini drive mechanism of FIG. 1 in the deployed position.
Figure 3:
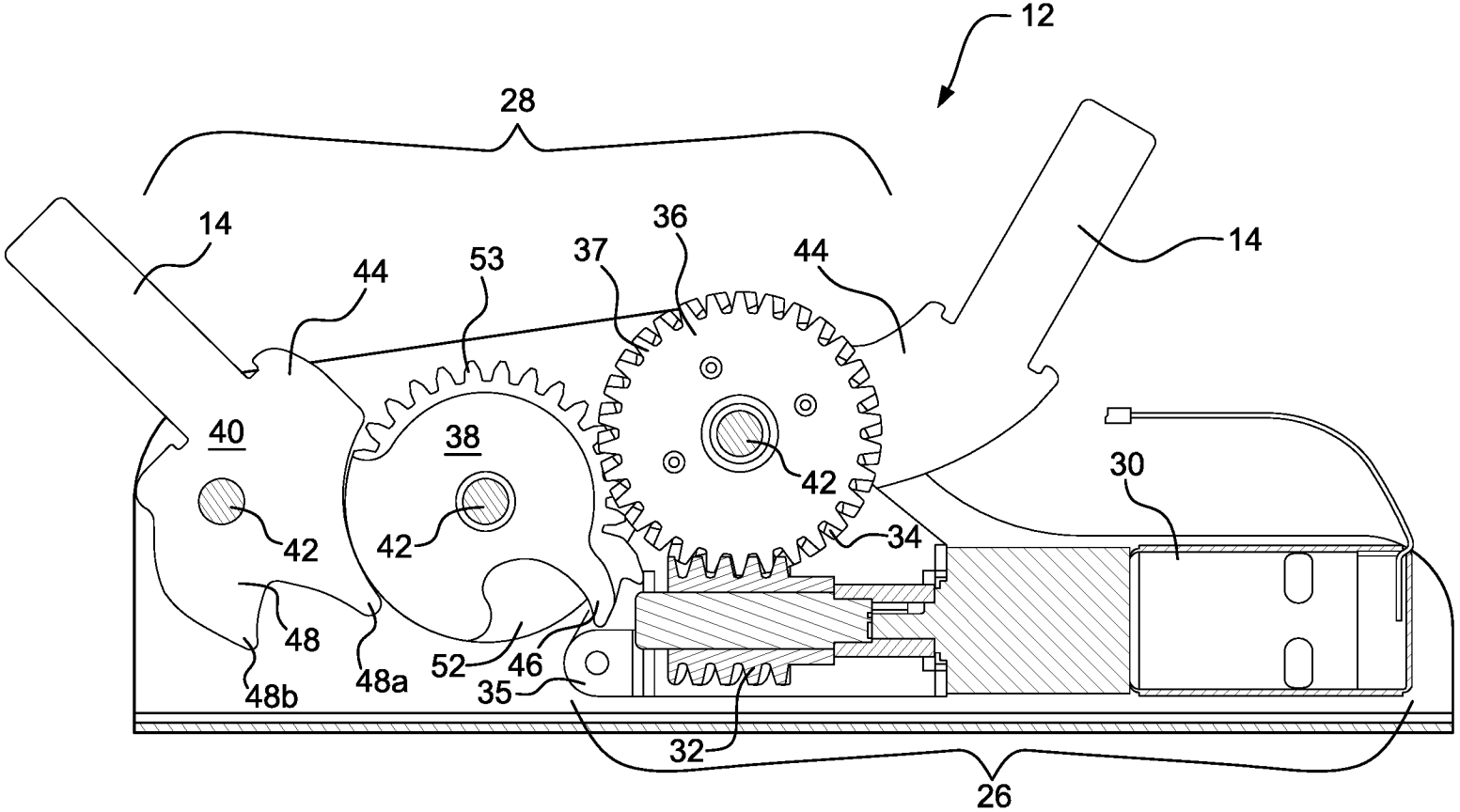
FIG. 3 is a cross sectional view of the bimini drive mechanism of FIG. 2.

The pivot hub 40 and associated bimini arm 14 are pivoted between the retracted or down position shown in FIG. 1 and the deployed or up position shown in FIGS. 2 and 3. The deployed position for the bimini arm 14 connected to the pivot hub 40 is generally at an angle or arc less than 90° from the generally horizontal retracted position and is preferably between 10-60°. The driven hub 36 and connected bimini arm 14 are pivoted between the generally horizontal retracted position shown in FIG. 1 to the deployed position shown in FIGS. 2 and 3, spanning an arc more than 90°. The angle of the bimini arm connected to the driven hub 36 is preferably at an angle generally between 120-180° from horizontal. As described in more detail below, the smooth edge 52 of the intermediate hub 38 and the smooth circular valley 50 of the pivot hub 40 enable the gear train 28 to position the driven hub 36 and the pivot hub 40 across different arcs with a single worm screw 32.

Figure 4:
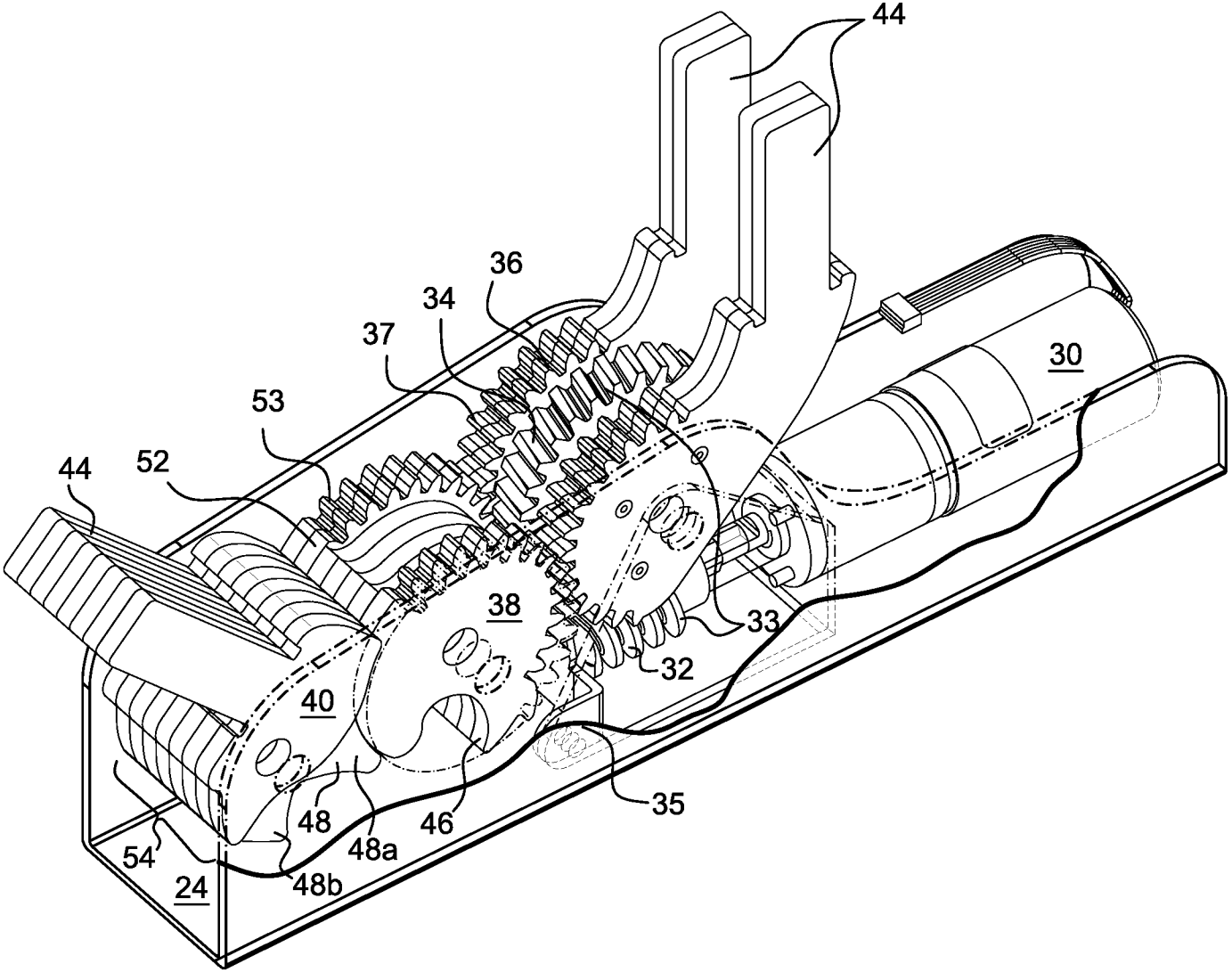
FIG. 4 is a top perspective partial phantom view of the bimini drive mechanism of FIG. 2.
Figure 6:
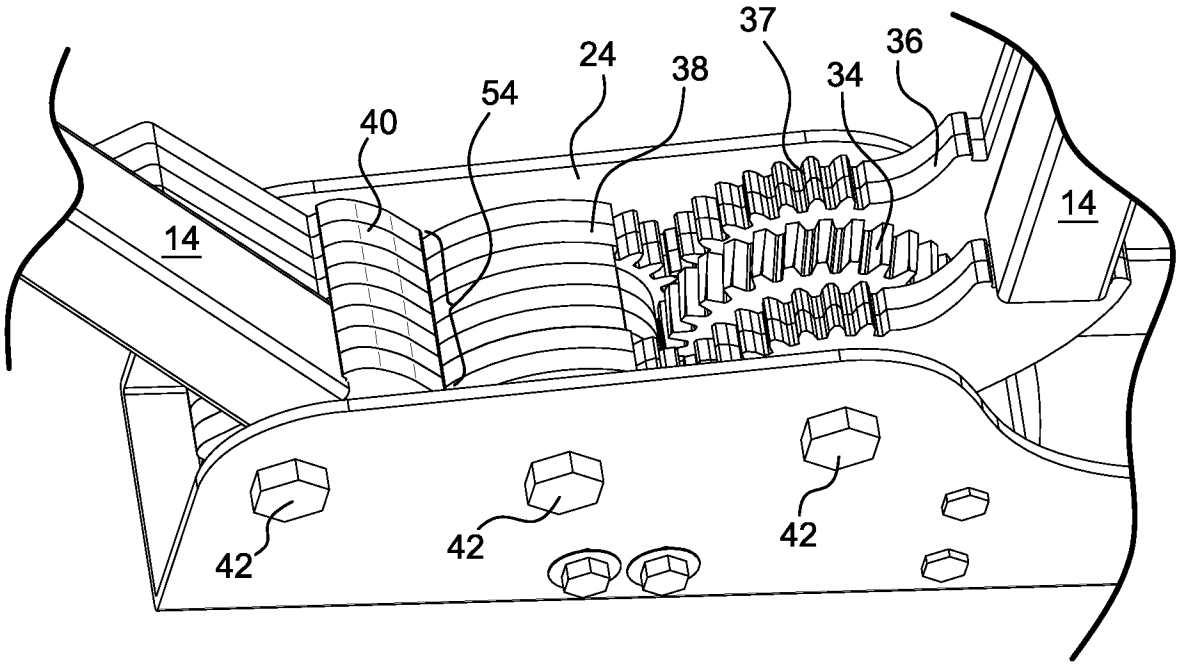
FIG. 6 is a top internal perspective view of the bimini drive mechanism of FIG. 2.

As shown in FIGS. 4-6, each hub may have spacers or shims 54 disposed between at least two functional outer faces of each hub, the spacers or shims serving to broaden the width of each hub to create a better base for the bimini arms 14. All faces and shims of the hubs are maintained on their respective bolts or axles 42 that secure the hubs to the housing 24. In one embodiment, the worm gear 34 interacting with the worm screw 32 is disposed between the functional outer faces of the driven hub 36. It should be noted that in other embodiments, the worm gear 34 could be disposed between the functional outer faces of either of the intermediate hub 38 or the pivot hub 40, with the worm screw 32 positioned to interact with the worm gear 34. In another embodiment, the worm screw 32 may be placed to directly interact with and drive the driven hub 36.

As shown in FIG. 1, the bimini arms 14 begin in the stowed position with the bimini arms and associated arm connectors 44 angled to one end of the housing 24 and correspondingly the boat structure. As the motor 30 drives the worm screw 32, the worm gear 34 rotatably maintained with the driven hub 36 is actuated in meshing engagement with the worm screw 32. Rotation of the driven hub 36 causes the bimini arm 14 connected to the driven hub arm connector 44 to pivot radially into a deployed position (clockwise in FIG. 1). The gear teeth 37 of the driven hub interact with and drive the gear teeth 53 of the intermediate hub 38. Rotation of the intermediate hub 38 causes rotation of the lip 46. When the bimini arms 14 are in the stowed position, the lip 46 rests between the prongs 48*a*, 48*b* of the pivot hub cam 48. As the drive mechanism is actuated to the deployed position as shown in FIGS. 2-3, the lip 46 pushes against the bottom prong 48*b* of the cam and pivots the pivot hub 40 into a deployed position with the arm connector 44 and bimini arm 14 angled in a generally vertical position. Once the two-pronged cam 48 is positioned downwardly in the deployed position, the smooth circular valley 50 of the pivot hub 40 bears against the smooth edge 52 of the intermediate hub 38. The driven hub 36 and intermediate hub 38 will keep rotating until the lip 46 is rotated to meet a surface of the driven hub 36 and create a hard stop for the drive mechanism in the deployed position. The pivot hub 40 is maintained in the deployed position by the passive sliding of the smooth circular surfaces of the pivot hub 40 and intermediate hub 38 as the intermediate hub continues to the hard stop.

Figure 8:
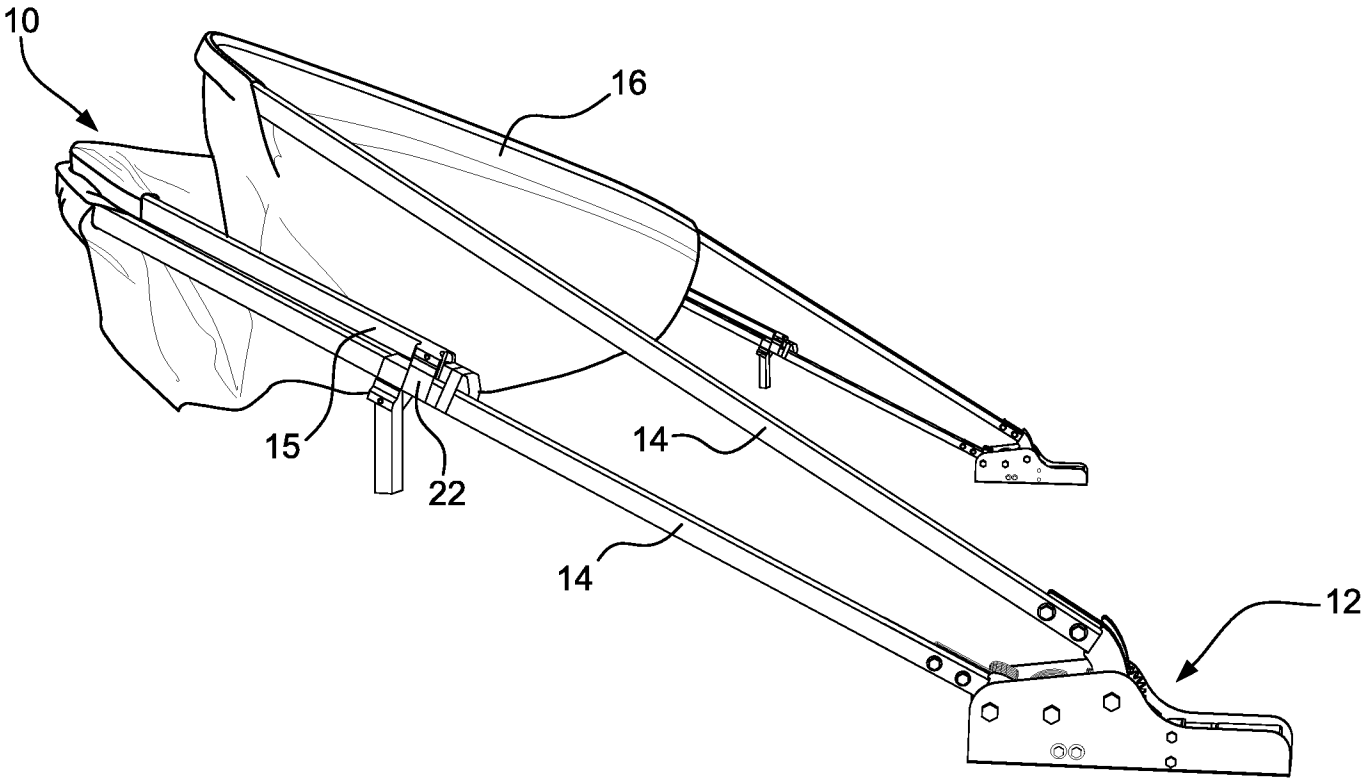
FIG. 8 is a perspective view of the bimini top system of FIG. 7 in a position intermediate the stowed and deployed positions.

When the driven hub 36 meets the hard stop of the lip 46, the arm connector 44 and associated bimini arm 14 are in a generally vertical position but are angled towards the opposite end of the housing 24 and boat structure from the stowed position. While the drive mechanism is actuated to the deployed position, the canopy 16 connected to the bimini arms 14 unfolds, as is shown in FIG. 8. Once the drive mechanism hits the hard stop, the canopy 16 is fully stretched between the bimini arms and maintains the bimini arms 14 and associated arm connectors 44 in tensioned engagement to provide shade from the sun to the user. A safety mechanism may be present in the system where if one of the bimini arms hits an object or obstruction, then the drive mechanism 12 will come to a complete stop.

The bimini can be actuated to the stowed position from the deployed position by reversal of the worm screw 32 and therefore the drive mechanism 12. When the drive mechanism 12 is actuated to the stowed position, the lip 46 of the intermediate hub is rotated to the pivot hub 40 where it pushes against the top prong 48*a* of the cam 48 and returns the pivot hub 40 into the stowed horizontal position. As the bimini arms 14 move toward each other to the stowed position, the canopy 16 is folded, and the bimini arms 14 return to a generally horizontal position angled towards one end of the boat where they are clear of the usable floor space on the boat structure.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A drive mechanism for a bimini top including a pair of bimini arms supporting the bimini top, the drive mechanism comprising:

a motor;

a worm screw coupled with the motor for rotation by the motor;

a worm gear coupled with the worm screw, the worm gear defining a driven hub to which one of the pair of bimini arms is connectable;

an intermediate hub coupled with the driven hub, the intermediate hub including gear teeth along a first portion of its circumference, a smooth edge along a second portion of its circumference, and a lip; and a pivot hub engaging the intermediate hub, the pivot hub including a cam engaging the lip of the intermediate hub, and the pivot hub including a smooth circular valley engageable with the smooth edge of the intermediate hub, wherein the other of the pair of bimini arms is connectable to the pivot hub.

2. A drive mechanism according to claim 1, wherein the driven hub is rotatable across an arc greater than 90 degrees.

3. A drive mechanism according to claim 2, wherein the driven hub is rotatable across an arc between 120-180 degrees.

4. A drive mechanism according to claim 1, wherein the pivot hub is rotatable across an arc less than 90 degrees.

5. A drive mechanism according to claim 4, wherein the pivot hub is rotatable across an arc between 10-60 degrees.

6. A bimini system for installation on a boat comprising: the drive mechanism of claim 1;

a pair of bimini arms connected to the drive mechanism; and a canopy connected between the pair of bimini arms.

7. A bimini system according to claim 6, wherein the boat includes a port side and a starboard side, the bimini system comprising two of the drive mechanisms secured to the port side and the starboard side, respectively, wherein the bimini arms are connected between the two drive mechanisms.

8. A bimini system according to claim 7, wherein each of the drive mechanisms are secured in a housing.

9. A drive mechanism for a bimini top including a pair of bimini arms supporting the bimini top, the drive mechanism comprising:

a motor;

a worm screw coupled with the motor for rotation by the motor;

a driven gear coupled with the worm screw, wherein one of the pair of bimini arms is connected to the driven gear, and wherein the driven gear is configured for displacement between a stowed position and an extended position by operation of the motor; and a pivot hub engaging the driven gear via an intermediate hub, wherein the other of the pair of bimini arms is connected to the pivot hub, the pivot hub and intermediate hub being configured for displacement between a down position and an up position by operation of the motor through the driven gear and the intermediate hub, wherein a first arc spanned by the driven gear between the stowed position and the extended position is greater than a second arc spanned by the pivot hub between the down position and the up position.

10. A bimini system for installation on a boat comprising: the drive mechanism of claim 9;

a pair of bimini arms connected to the drive mechanism; and a canopy connected between the pair of bimini arms.

11. A bimini system for installation on a boat, the system comprising:

a pair of arms pivotally mounted to the boat for pivotal movement relative to one another;

a canopy supported by the arms; and a drive mechanism for moving the arms from a stowed position in which the canopy is folded to a deployed position in which the canopy is extended to cover at least a portion of the boat, the drive mechanism including a worm screw, the worm screw drivingly connected to a worm gear, a gear train drivingly connecting the worm screw with the arms whereby rotation of the worm gear rotates a first arm actuator, the first arm actuator drivingly connected with an intermediate arm actuator, and the intermediate arm actuator drivingly connected with a second arm actuator to move the arms between the stowed and deployed positions as the worm screw is actuated, wherein the first arm actuator contains gear teeth, the intermediate arm actuator contains gear teeth, and the gear teeth of the first arm actuator drivingly engage the gear teeth of the intermediate arm actuator, wherein the intermediate arm actuator further comprises a smooth circular surface, and wherein the second arm actuator comprises a complementary smooth circular surface.

12. A bimini system according to claim 11, wherein a motor is connected to and actuates the worm screw.

13. A bimini system according to claim 11, wherein the second arm actuator further comprises a valley, the intermediate arm actuator further comprises a protrusion, and the protrusion interacts with the valley to pivot the second arm actuator into sliding engagement with the intermediate arm actuator, wherein the intermediate arm actuator smooth circular surface abuts the second arm actuator smooth circular surface.

14. A bimini system according to claim 11, wherein both of the first arm actuator and the second arm actuator are fixedly connected to an arm.

* * * * *